US005615740A

United States Patent [19]

Comeau et al.

[11] Patent Number: 5,615,740

[45] Date of Patent: Apr. 1, 1997

[54] INTERNAL PRESSURE SLEEVE FOR USE WITH EASILY DRILLABLE EXIT PORTS

[75] Inventors: Laurier E. Comeau; Ian Gillis, both of Leduc; Elis Vandenberg, Sherwood Park, all of Canada

[73] Assignee: Baroid Technology, Inc., Houston, Tex.

[21] Appl. No.: 496,775

[22] Filed: Jun. 29, 1995

[51] Int. Cl.[6] ..... E21B 33/13

[52] U.S. Cl. ..... 166/380; 166/117.5; 175/77

[58] Field of Search ..... 166/50, 117.5, 166/117.6, 242.1, 154, 153, 380, 386, 317, 229; 175/61, 62, 77, 78, 79

[56] References Cited

U.S. PATENT DOCUMENTS

| | | | |
|---|---|---|---|
| 3,811,500 | 5/1974 | Morrisett et al. | 166/154 |
| 4,042,014 | 8/1977 | Scott | 166/154 X |
| 4,415,205 | 11/1983 | Rehm et al. | 299/5 |
| 5,038,862 | 8/1991 | Giroux et al. | 166/154 X |
| 5,388,648 | 2/1995 | Jordan, Jr. | 166/50 X |
| 5,458,209 | 10/1995 | Hayes et al. | 175/61 |

*Primary Examiner*—William P. Neuder
*Attorney, Agent, or Firm*—Browning Bushman

[57] ABSTRACT

A joint of tubular casing with a pre-formed window in its sidewall has a tubular sleeve fixedly attached to the interior of the tubular casing by a plurality of shearable set screws. The exterior surface of the sleeve is sealed to the interior surface of the tubular casing on opposing sides of the window. The window is filled with a fluid, and then the window is covered with one or more layers of a composite material such as fiberglass. In use, the joint of tubular casing is run down to the depth of interest in an earth borehole, and then the window is oriented with respect to the formation of interest at the depth. The joint of tubular casing is then cemented in place, after which the tubular sleeve is retrieved by the use of a fishing tool, causing the set screws to shear upon the upward movement of the fishing tool. After the interior sleeve is retrieved, a whipstock is lowered into the cased borehole, until it is oriented and anchored therein. The assembly automatically fixes the axial and circumferential orientation of the whipstock within a surrounding casing joint and holds the assembly in place. Alignment and fixing of the whipstock ensures proper engagement and orientation of a drill bit with an access window formed in the casing wall. A drilling assembly is lowered into the casing and a lateral bore is drilled off the whipstock through the composite material and into the surrounding formation.

16 Claims, 9 Drawing Sheets

FIG. 17
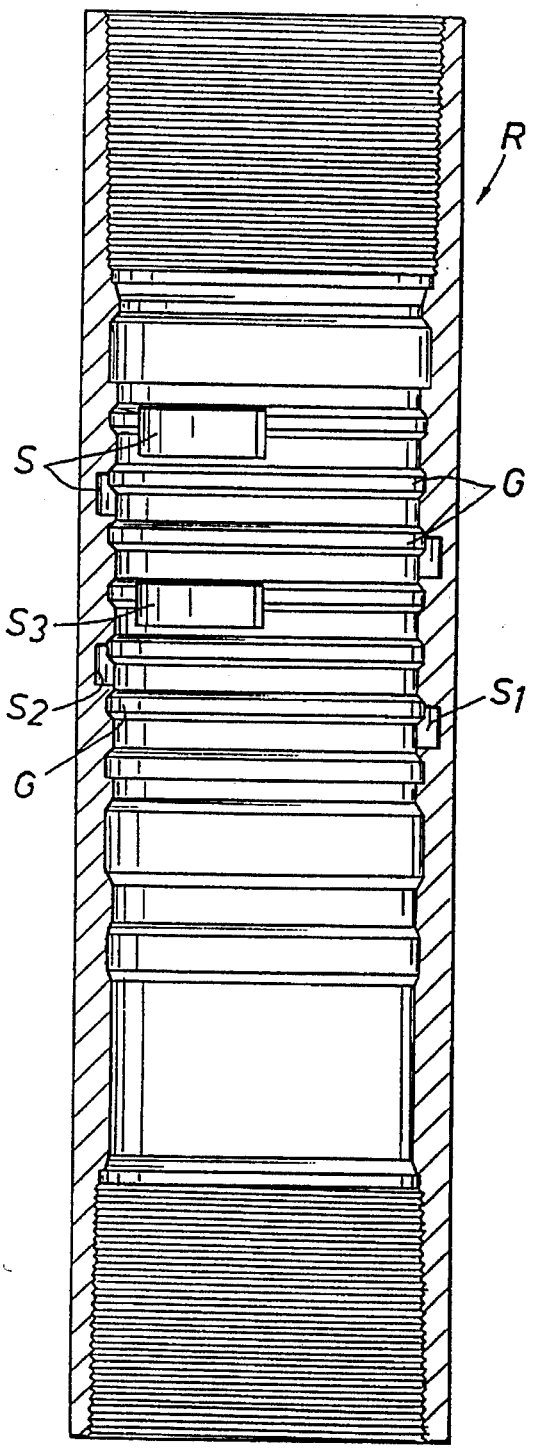
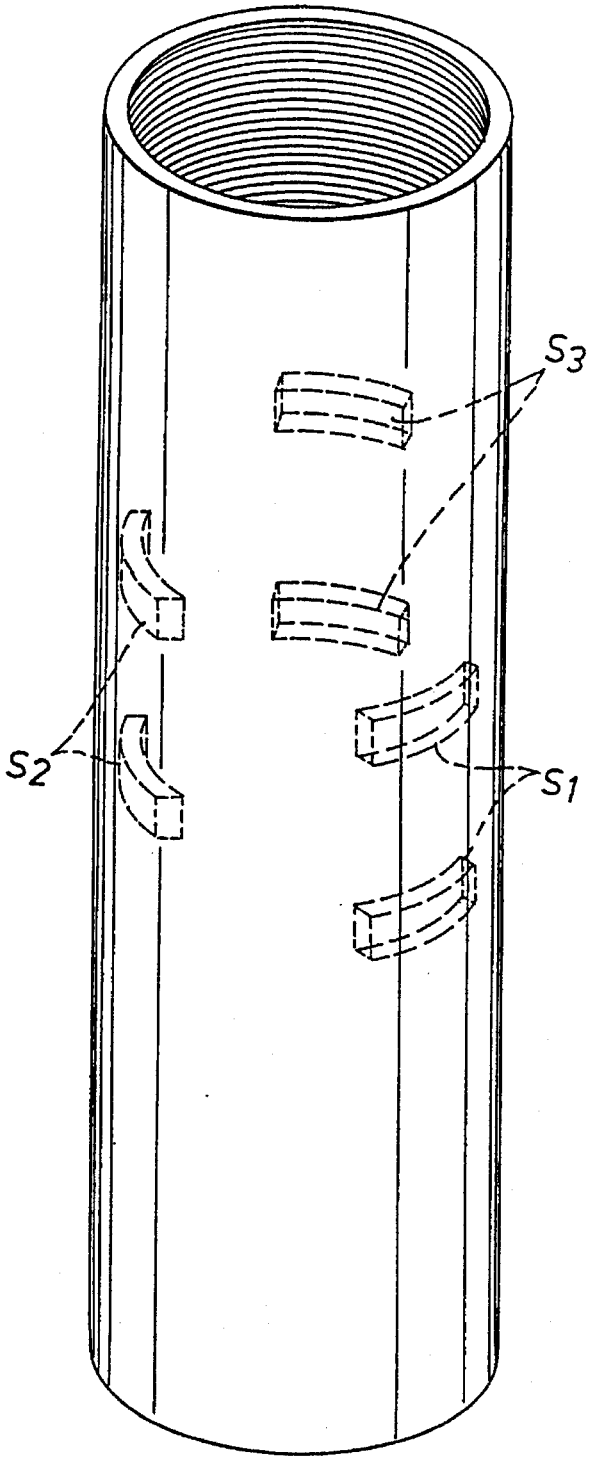
FIG. 18

INTERNAL PRESSURE SLEEVE FOR USE WITH EASILY DRILLABLE EXIT PORTS

RELATED APPLICATION

This application contains matter common to that contained in U.S. application Ser. No. 08/496,504, filed on Jun. 29, 1995, entitled KEYLESS LATCH FOR ORIENTING AND ANCHORING DOWNHOLE TOOLS, in the names of Larry comeau, et al.

BACKGROUND OF THE INVENTION

This invention relates generally to apparatus used in drilling lateral wells from vertical wells, for purposes of producing oil and gas from subsurface formations.

Since its usage began, horizontal drilling has offered dramatic reservoir-exposure improvements. Lately, a new trend has developed towards drilling multiple laterals, thus further increasing production. Until recently, laterals typically were not cased and tied back, which meant when workovers or cleanouts were required, reentry was difficult and completions were virtually impossible.

Now, the technology allows multiple laterals to be cased and tied back. Multilaterals may be drilled into predetermined producing-formation quadrants at any time in the productive life cycle of wells and can be used in vertical, directional or horizontal applications.

Minimizing the distance hydrocarbons must travel to the wellbore is an important goal. One surface hole installation can now incorporate an integral casing drainage system that takes the wellbore to the hydrocarbons in place.

The same directional bottomhole assembly used to initiate the kickoff is used to drill the build or turn portion of the lateral wellbore. Once a lateral has been drilled, a secondary liner and hanger system is placed into the newly drilled wellbore and mechanically tied back to the main casing string, allowing future re-entry into the new leg. The deflection device can immediately be moved to the next window joint upon installation of the lateral string.

Either the drilling cycle can commence on the next lateral, or the deflection device can be retrieved to surface, enabling access to all casing strings. The deflection device can, alternatively, be left on bottom, to be available if additional laterals are drilled at some other time, to further improve reservoir recovery based on performance of the original wellbore and its added lateral or laterals.

Additional benefits are that the system creates a natural separator for oil and gas production in vertical applications, and it creates the opportunity to drill, complete and produce from several different formations tied to one surface-hole casing string.

An integral part of the system for drilling either a single lateral well, or a multiple lateral well scenario, is the so-called casing window joint, a joint of steel casing having a pre-cut or pre-formed window which is easily drillable. The casing window system is available in various oilfield-tubular material grades. The completed casing window is then overwrapped with composite materials (similar to fiberglass).

PRIOR ART

U.S. Pat. No. 4,415,205, issued on Nov. 15, 1983, to William A. Rehm et at., discloses in its Col. 1, lines 56–59; Col. 2, lines 5–8; Col. 3, lines 17–25; and Col. 5, lines 2–8, the use of a special window cut into the steel casing which is covered by fiberglass to provide an easy exit port through which a lateral hole can be easily drilled. In the absence of such a pre-cut hole, the steel casing can be very difficult to drill through, typically requiring the use of a conventional casing mill.

A similar system is described in U.S. patent application Ser. No. 08/074,475, filed on Jun. 11, 1993, now U.S. Pat. No. 5,458,209, in which there is disclosed with respect to its FIGS. 11A, 11B and 11C, the use of a pre-cut opening 21 in the steel casing, covered by fiberglass, which can be easily drilled.

However, the use of such a prior art system, in which a pre-cut or pre-formed hole is covered with an easily drillable covering, for example, fiberglass, creates an additional problem. The fiberglass covering simply cannot withstand the high pressures frequently encountered in drilling oil and gas wells, sometimes being at 5,000 to 10,000 psi levels.

For example, in U.S. Pat. No. 4,415,205, in Col. 5, commencing on line 5, the prior art recognizes the inability of the fiberglass to withstand the pressures encountered at greater depths and that conventional casing mills should be used instead. The prior art has thus provided no systems for easily drilling lateral wells in high pressure environments.

It is therefore the primary object of the present invention to provide a system for drilling lateral wells in high pressure environments using casing having an easily drillable exit port.

SUMMARY OF THE INVENTION

The objects of the invention are accomplished, generally, by the use of a retrievable pressure sleeve pinned within the interior of the casing, adjacent the window in the casing. Once the casing has been cemented in place, the sleeve is retrieved to the earth's surface.

As an additional feature of the invention, the window is filled with a fluid to prevent the covering over the window from deforming inwardly through the window in response to the external pressures encountered in the downhole environment.

BRIEF DESCRIPTION OF THE DRAWINGS

These and other objects, features and advantages of the present invention will be more readily appreciated from a reading of the detailed specification, in conjunction with the drawings, in which:

FIG. 17 is a detailed elevation, in cross-section, illustrating details in the internal coupling recesses; and FIG. 18 is an isometric view illustrating the circumferential spacing and axial positioning of internal recess slots formed on the inner surface of the casing.

DETAILED DESCRIPTION OF THE PREFERRED EMBODIMENT

Figure 1:
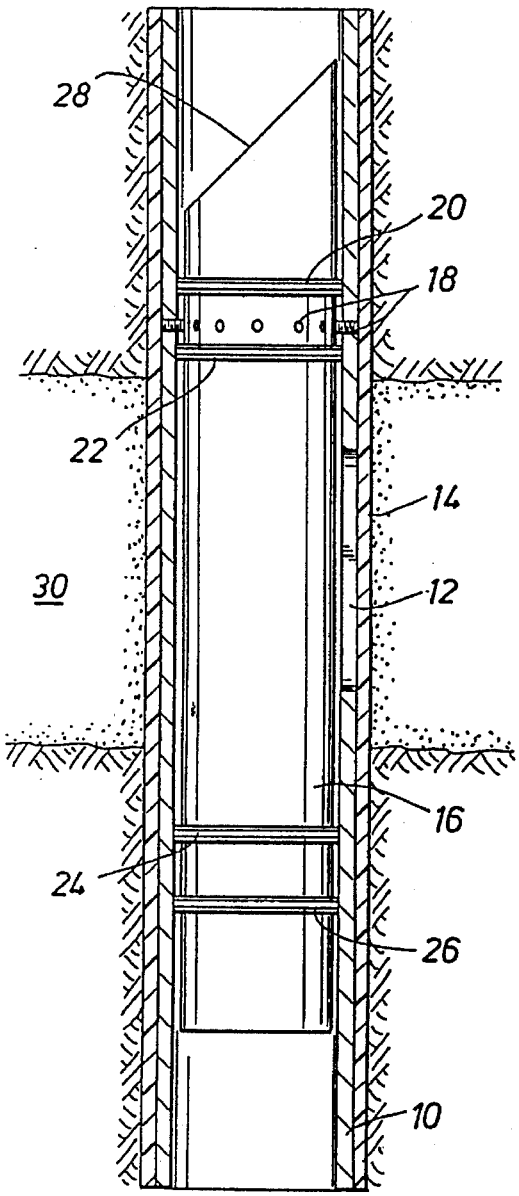
FIG. 1 is a simplified, elevated, diagrammatic view, partly in cross-section, of an internal pressure sleeve according to the present invention, in place in the interior of a casing having a pre-cut, easily drillable hole therein.

Referring now to FIG. 1, a tubular, steel casing 10 is illustrated as having a pre-cut or pre-formed hole 12 therein. The outer surface of the casing 10 is wrapped with one or more layers of fiberglass 14, thus providing the easy exit port 12 through the casing 10.

The tubular sleeve 16 is located within the interior of the casing 10, held in place by a plurality of set screws 18 which pin the sleeve 16 to the casing 10. O-rings 20, 22, 24 and 26 prevent any liquids or gasses from passing along the annular space between the casing 10 and the tubular sleeve 16 coming from the exit port 12. A conventional muleshoe 28 is located at the upper end of the tubular sleeve 16 for oftenting the casing 10 and the sleeve 16 as appropriate, as described in more detail hereinafter.

In the operation of the system diagrammatically illustrated in FIG. 1, the internal sleeve 16 is pinned in place within the casing 10 at the earth's surface. The combined casing 10 and sleeve 16 are then run into an earth borehole, already drilled by conventional methods, until the exit port 12 is located at the desired vertical depth, within the region of interest 30 in the earth formation. The orientation of the exit port 12 is determined by causing a conventional survey instrument having a complementary muleshoe on its lower end to land on the muleshoe 28. By rotating the casing string from the earth's surface, the exit window 12 is thus oriented. Once the exit port 12 is correctly oriented, the casing is typically cemented in place, in the earth borehole, after which a conventional fishing tool is run from the earth's surface, down through the casing 10, the internal sleeve 16, and out the lower end of the sleeve 16. Although the fishing tool (not illustrated) can take various forms, a typical fishing tool for this operation can have one-way dogs, which spring up upon exiting the lower end of the sleeve 16, and actually grapple the lower end of sleeve 16. By pulling up on the fishing tool, the set screws 18 will shear out and the internal pressure sleeve 16 can be retrieved to the earth's surface.

Figure 8:
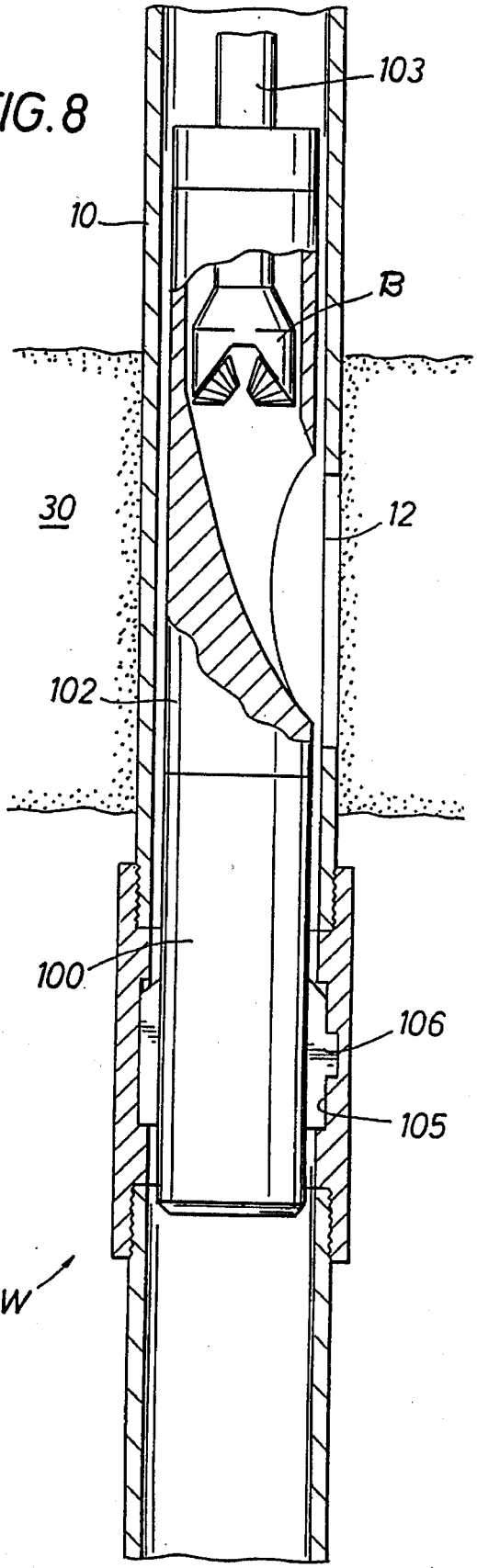
FIG. 8 is a generalized schematic view, partially cut away, illustrating the assembly of the present invention being used to locate, anchor and orient a whipstock within a specially recessed casing joint.

Following retrieval of the internal pressure sleeve 16, a conventional whipstock, such as is illustrated in FIG. 8, is lowered by a conventional running tool through the casing 10, and once oriented with the orientation of the exit port 12, for example, through the use of a conventional key lug on the interior of the casing 10, is anchored immediately below the exit port 12. With the whipstock anchored in place and its running tool retrieved from the borehole, a conventional drilling operation is commenced, in which a drill bit at the lower end of a drillstring is lowered down to the whipstock and caused to drill off the whipstock, through the fiberglass covered exit port 12, any cement outside the exit port 12, and into the formation of interest 30. If desired, a keyless oftenting and latching system described hereinafter with respect to FIGS. 8–18 can be used.

Those skilled in the art will recognize that this system could sometimes function without the use of the fiberglass layer or layers 14. However, the preferred embodiment makes use of the fiberglass layer 14 to keep debris in the borehole from entering the exit port into the annulus between the casing 10 and sleeve 16, in between the O-ring 22 and the O-ring 24.

As an additional feature of the invention, a generally incompressible fluid is placed in the exit port 12 prior to wrapping the casing 10 with the fiberglass 14, thus preventing the fiberglass layer 14 from deforming into the exit port 12 when exposed to high pressures external thereto.

Figure 2:
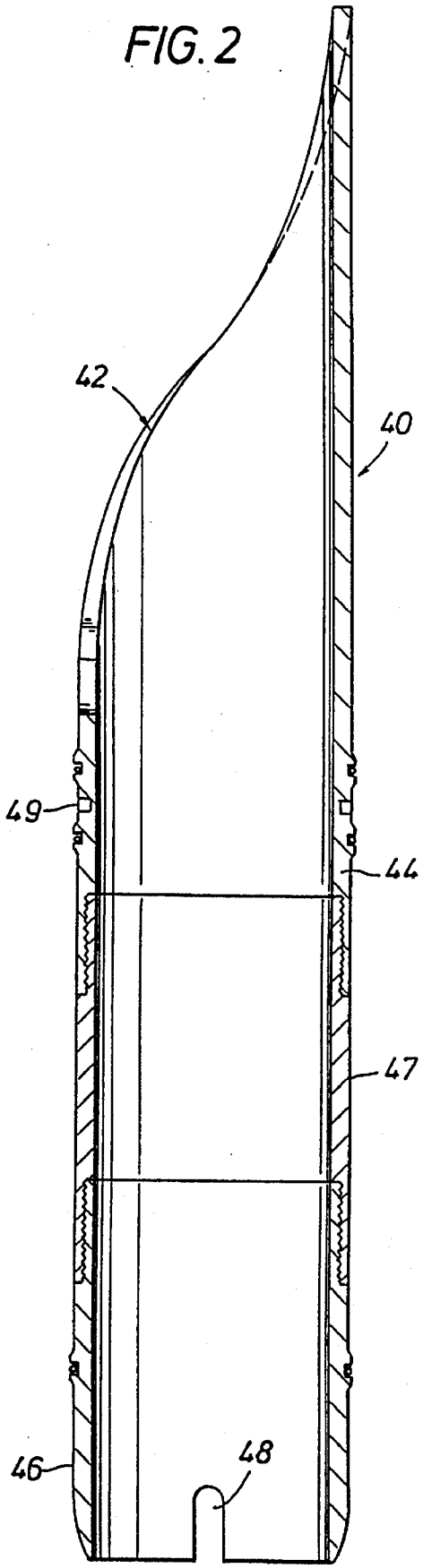
FIG. 2 is an elevated, cross-sectional view of the internal pressure sleeve according to the present invention.

Referring now to FIG. 2, the preferred embodiment of an internal pressure sleeve assembly 40 is illustrated in greater detail than that of the schematic representation of sleeve 16 in FIG. 1. The sleeve assembly 40 has a muleshoe 42 at the upper end of an upper coupling 44. A lower coupling 46, at the lower end of the sleeve assembly 40, has a pair of wrench slots 48, indexed at 180°, for tightening the parts of the assembly 40. The slots 48 can also be used for attachment by the fishing tool to facilitate retrieval of the sleeve assembly 40. Intermediate the upper coupling 44 and the lower coupling 46 is a sleeve 48.

Figure 3:
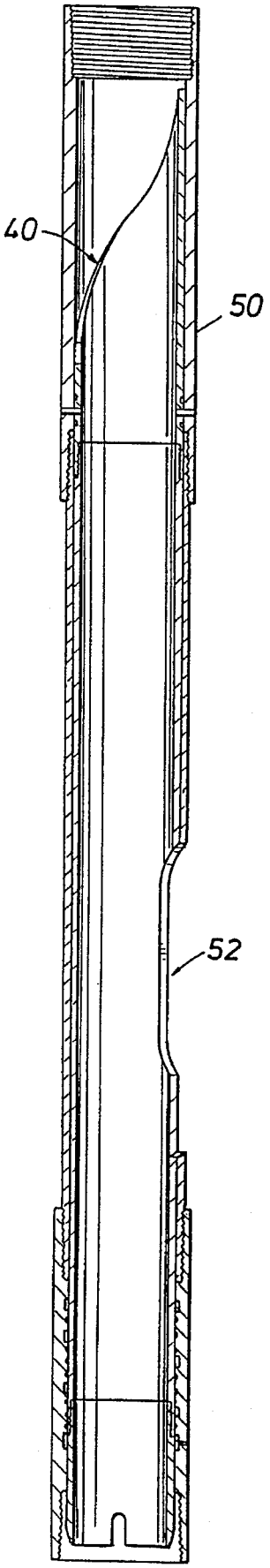
FIG. 3 is an elevated, cross-sectional view of the internal pressure sleeve of FIG. 2, in place in the interior of a casing having a pre-cut, easily drillable hole therein.

The tapped holes 49 in the upper coupling 44 receive the set screws (not illustrated in this drawing figure) which are used for attaching the sleeve assembly 40 to the casing, illustrated together in FIG. 3.

Referring now to FIG. 3, the sleeve assembly 40 is illustrated as being pinned to a casing joint 50 having a window (exit port) 52, prior to the casing 50 being wrapped with a composite material, for example, fiberglass.

Figure 4:
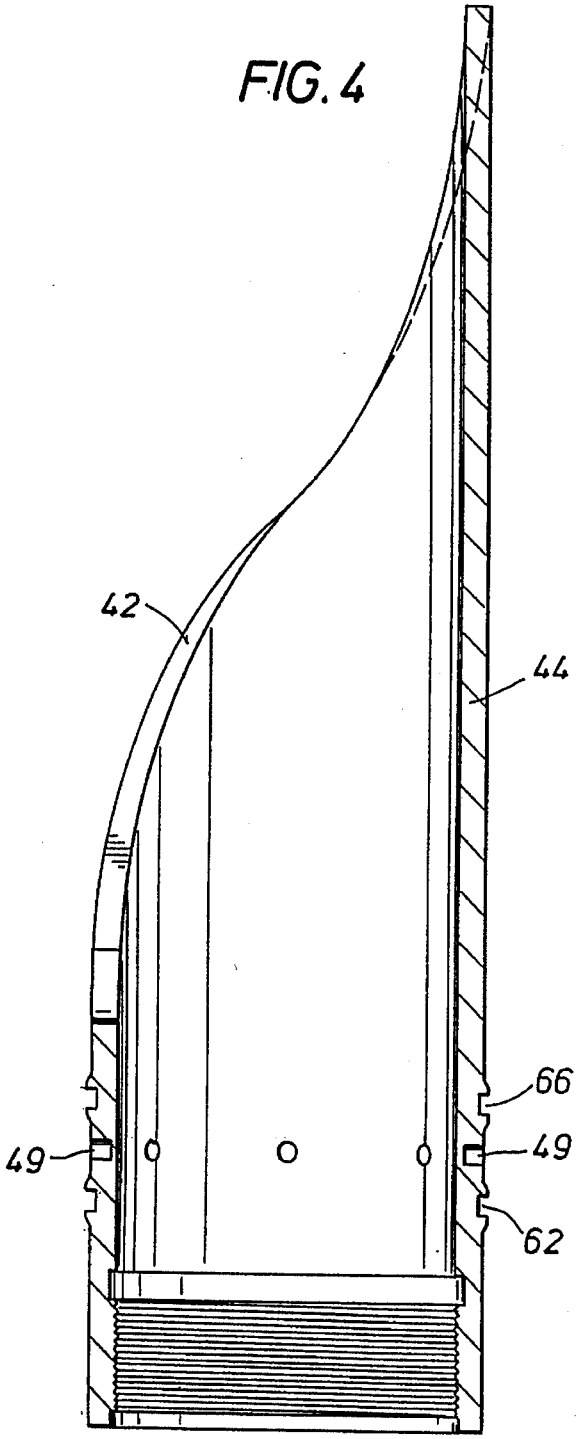
FIG. 4 is an enlarged, elevated, cross-sectional view of the upper coupling portion of the internal pressure sleeve according to FIG. 2.

Referring now to FIG. 4, the upper coupling portion 44 of the sleeve assembly 40 is illustrated in greater detail. The muleshoe 42, used for determining the orientation of the exit port 52 in the casing, is a 44.000 lead taper, single muleshoe. The O-ring receptacles 66 and 62 are formed on opposing sides of the tapped holes 49 which receive the set screws for attaching the sleeve assembly 40 to the casing joint 50. The upper coupling 44 has a female-threaded portion for being threadedly connected to the sleeve 47 illustrated in FIG. 6.

Figure 5:
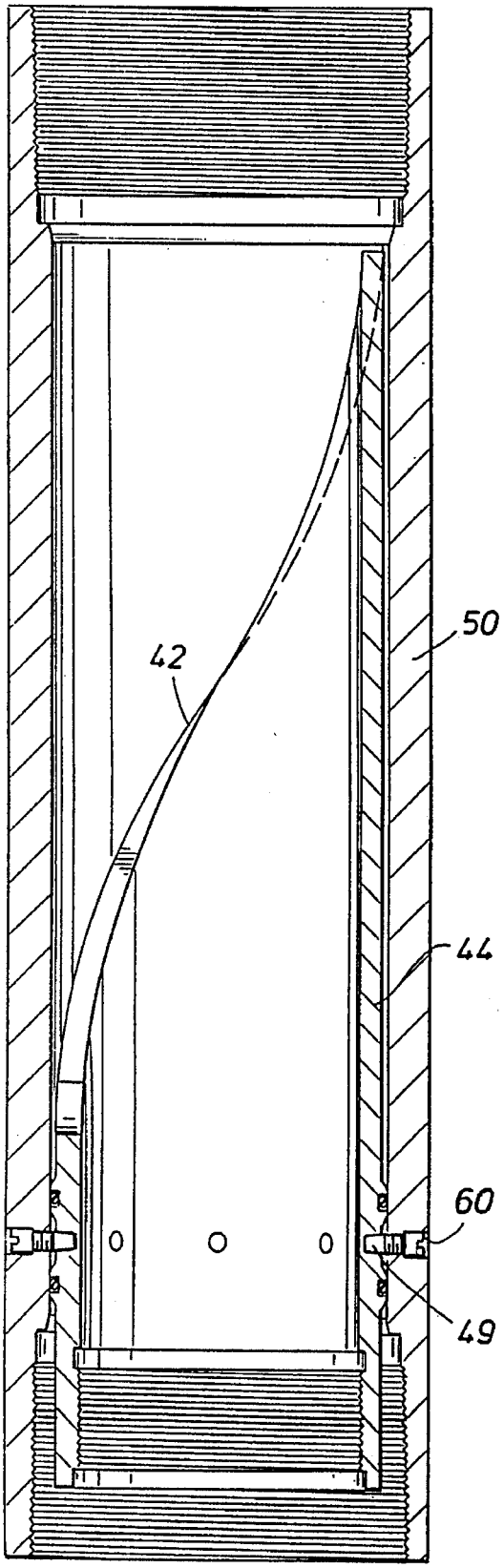
FIG. 5 is an elevated, cross-sectional view of the upper coupling illustrated in FIG. 4, in place in a section of casing.

Referring now to FIG. 5, the upper coupling 44 is illustrated as being pinned to the casing 50 through the use of set screws threaded into the casing holes 60 and the holes 49 in the upper coupling 44.

Figure 6:
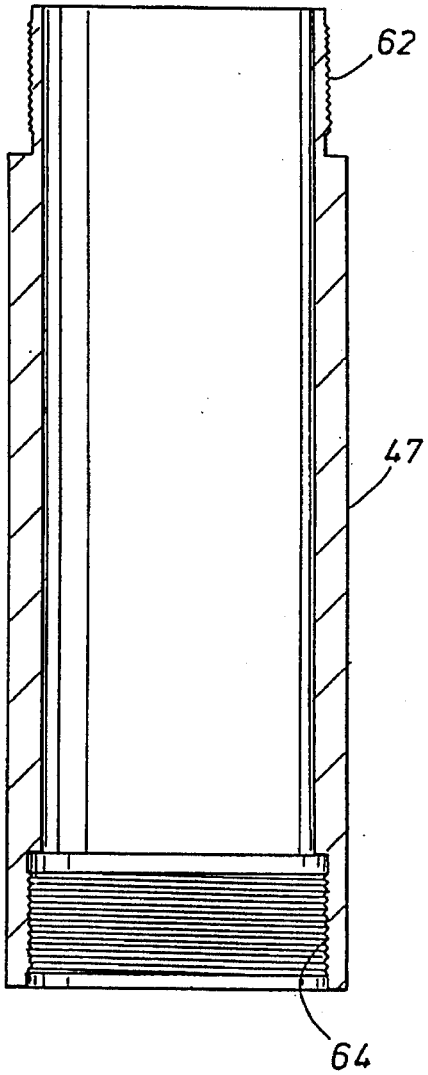
FIG. 6 is an enlarged, elevated, cross-sectional view of the center sleeve portion of the internal pressure sleeve illustrated in FIG. 2.

Referring now to FIG. 6, the sleeve 47 is illustrated in greater detail, having a first pin end (male threads) 62 for threadedly engaging the upper coupler 44 and a second box end (female threads) 64 for threadedly engaging the lower coupling 46.

Figure 7:
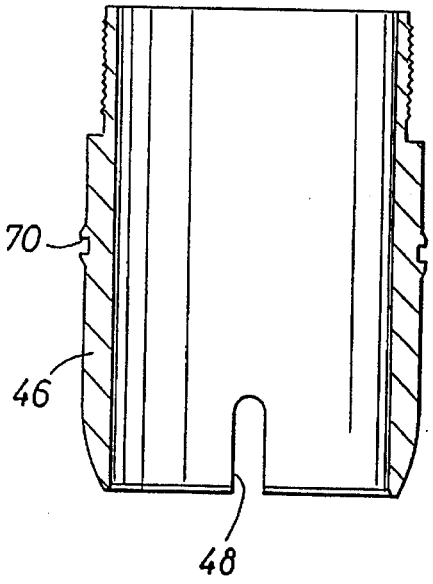
FIG. 7 is an enlarged, elevated, cross-sectional view of the lower coupling portion of the internal pressure sleeve according to FIG. 2.

Referring now to FIG. 7, the lower coupling 46 is illustrated in greater detail. Although only a single O-ring receptacle 70 is illustrated, a pair of such receptacles for housing a pair of O-rings such as O-rings 24 and 26 of FIG. 1 can be used if desired.

In the course of practicing the invention, it is contemplated that the following method may be used:

1. Windowed casing joints are placed in the main wellbore casing string and rotated at precise locations, to a predetermined orientation, to allow drilling of multilateral sections through predetermined paths.
2. The main casing string is cemented in place using primary cementing techniques.
3. Because the window joint contains an inner-pressure sleeve, securely held in place with O-rings, it can withstand more than normal weight buildup and thus maintain pressure integrity; plus, it also prevents cutting debris from entering the window opening.
4. After cementing the main casing string, the inner-pressure sleeve is retrieved using a standard fishing spear. The cavity created between the internal sleeve and the composite material (fiberglass) is filled with a non-compressible fluid medium and balanced to the external annulus.
5. The retrievable deflection tool (whipstock) is then landed and installed into the casing window joint.
6. The lateral section is drilled using conventional directional drilling techniques—from rotary assemblies to articulated short-radius assemblies, depending on desired wellbore path profile.
7. At TD of the lateral section, the drilling assembly is retrieved (while the whipstock is left in place), and the hole is cleaned to ensure that lateral liner and additional completion equipment can be installed.
8. Next, a lateral liner is run in the hole, to the top of which a lateral hanger assembly and specialized running tool are attached. The entire assembly is run into the wellbore on the end of a drillstring.
9. The running tools are run to depth and the lateral hanger assembly is landed within the window joint.
10. A hydraulic gate closing is activated to close a mechanical gate around the hanger, providing a mechanical seal. Surface pressure-recording equipment monitors the gate-travel and gate-closing process.
11. Next, a hydraulic collet is activated for release, and running tools are released and retrieved to surface.
12. With the retrievable deflection tool (whipstock) still there, the lateral is cemented in place using a cementing re-entry guide tool that allows the liner to be cemented using a dual-plug cement procedure.
13. The retrievable deflection tool (whipstock) is either moved to the next window to aid in drilling another lateral or removed from the wellbore.
14. Now, if needed, the lateral section can be re-entered by landing a completion whipstock in the windowed joint for subsequent operations.

FIG. 8 illustrates a well casing 10 extending down a vertical bore hole drilled into the earth. A preformed exit port or window 12 in the casing opens to a region of drilling interest 30 situated laterally away from the vertical well bore.

A laterally extending bore hole may be drilled to the region 30 using a whipstock assembly W indicated within the casing string 10 which deflects a drill bit B away from the vertical bore through the casing window 12. This basic technique for forming lateral well bores is well established and described in the prior art.

The whipstock assembly W includes an anchoring, positioning and orienting assembly 100 of the present invention secured to the bottom of a whipstock tool 102. The assembly W is suspended from a drill string 103 which extends to the surface. The string 103 is used in conventional fashion as a setting string to raise and lower the assembly as well as to rotate the drill bit B.

Specially configured recesses 105 formed along the interior surface of the casing 10 below the window 12 are designed to align with and receive moveable, spring loaded, latches 106 extending radially from the assembly 100. When the latches 106 are properly aligned axially and circumferentially with appropriate recesses in the well casing, the spring loading on the latches forces the latches to move radially outwardly into mating forms in the recesses. By selecting a unique pattern of mating latch and recess dimensions, circumferential orientation as well as axial positioning of the whipstock assembly may be achieved.

Once the assembly W has been anchored and oriented, the drillstring 103 is lowered and simultaneously rotated causing the bit B to advance along the inclined whipstock guide surface and through the window 12 to drill laterally into the surrounding formation in a conventional manner.

Figure 9:
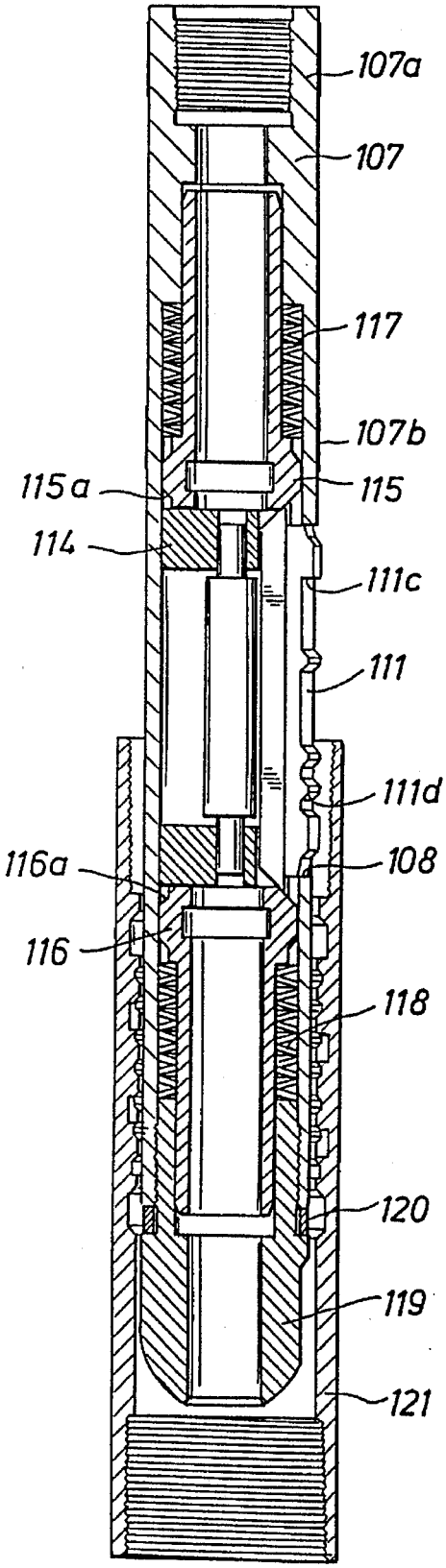
FIG. 9 is a detailed elevation, in cross-section, illustrating the assembly of the invention in its sliding configuration within a recessed casing coupling of the invention.
Figure 10:
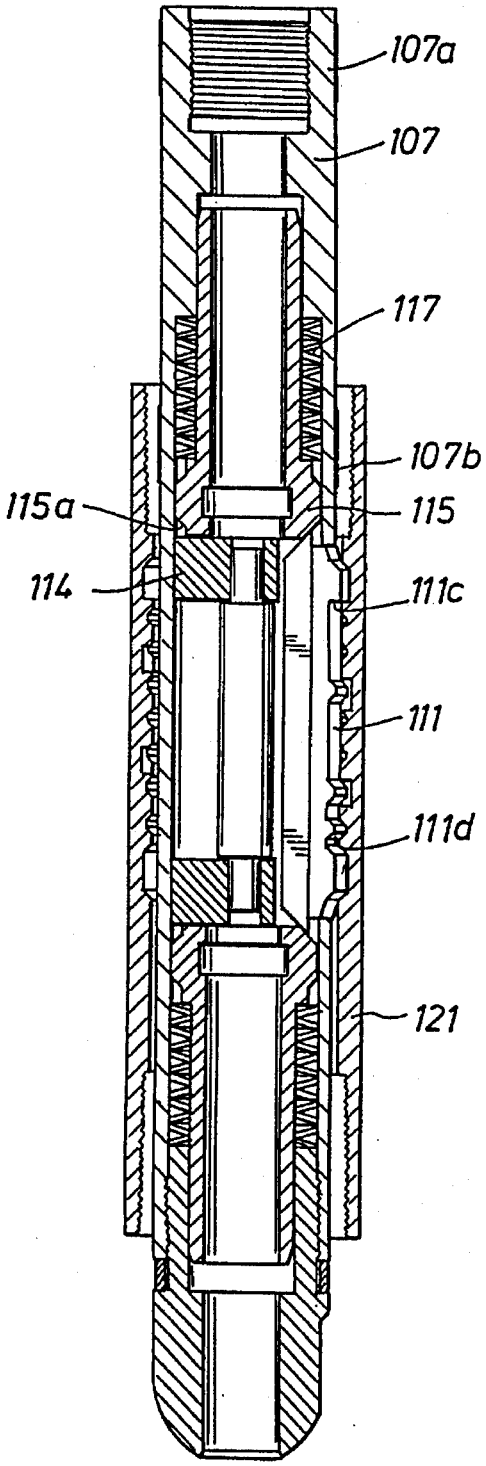
FIG. 10 is a view similar to FIG. 9 illustrating the assembly of the invention in its latched and oriented configuration within the receiving recesses of the surrounding casing coupling.
Figure 11A:
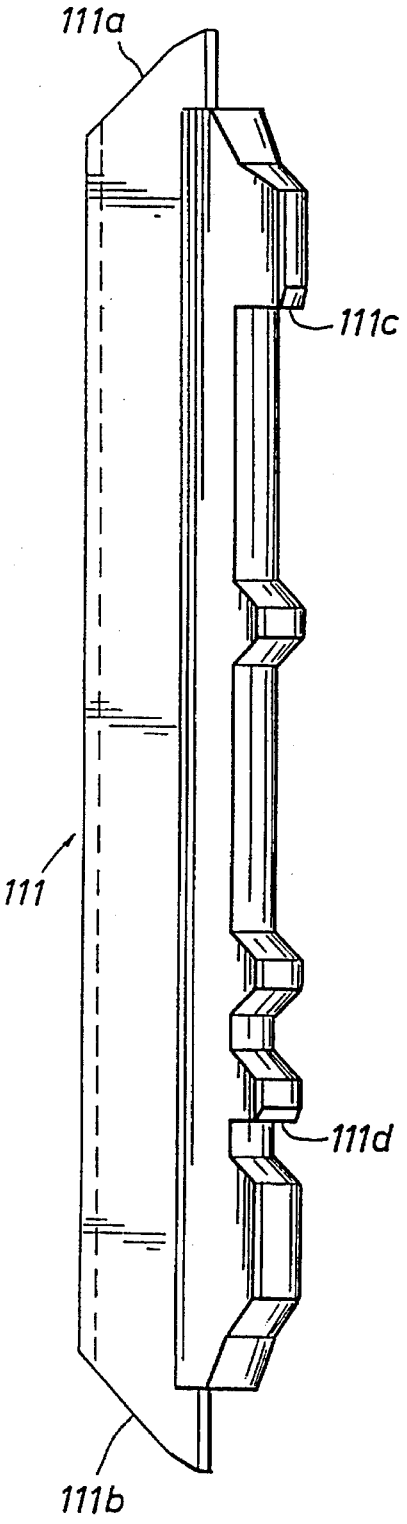
FIGS. 11*a*, 11*b*, and 11*c* are isometric views illustrating details in the profiles of the latches employed in one form of the invention.
Figure 11B:
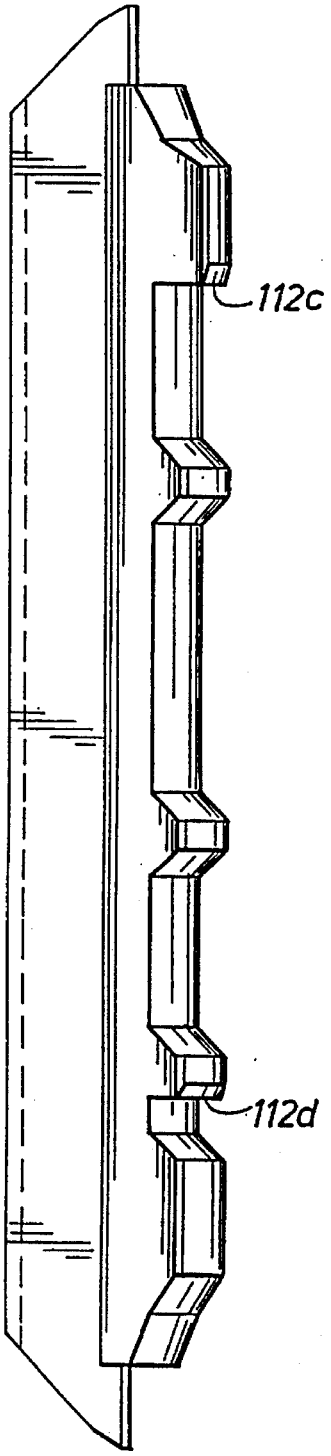
Figure 11C:
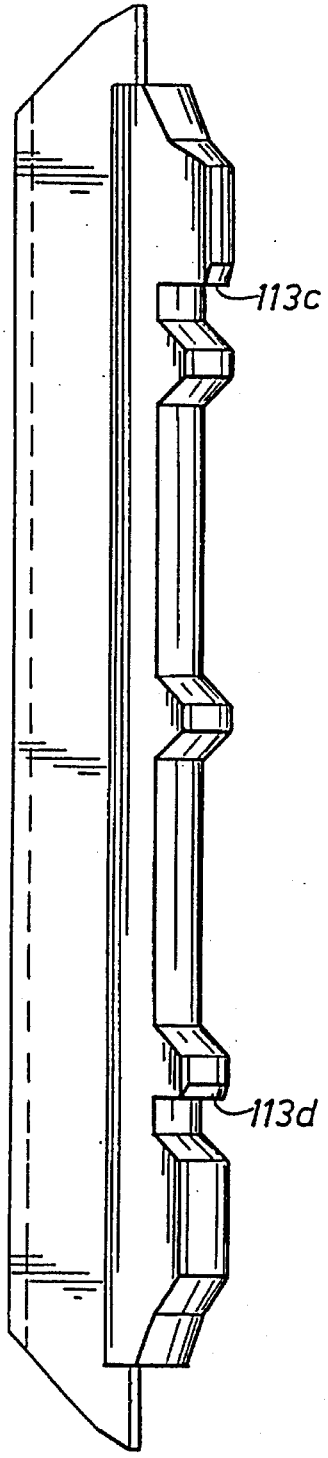

Details in the construction and operation of a preferred form of the invention may be seen with reference to FIGS. 9 and 10 showing the assembly 100 in its unset or non-anchored configuration (FIG. 9) and its set, oriented configuration (FIG. 10).

Figure 12:
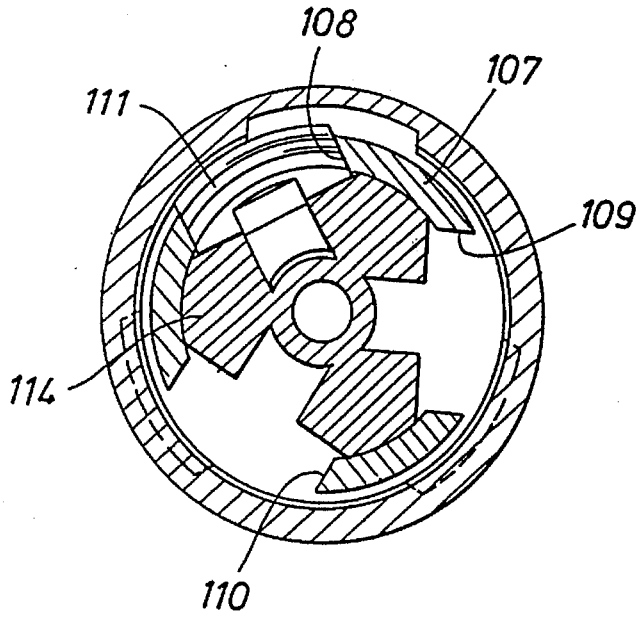
FIG. 12 is a cross-sectional view of the assembly illustrating the configuration of the latches as the assembly is moved through the casing to the area of the receiving recesses.
Figure 13:
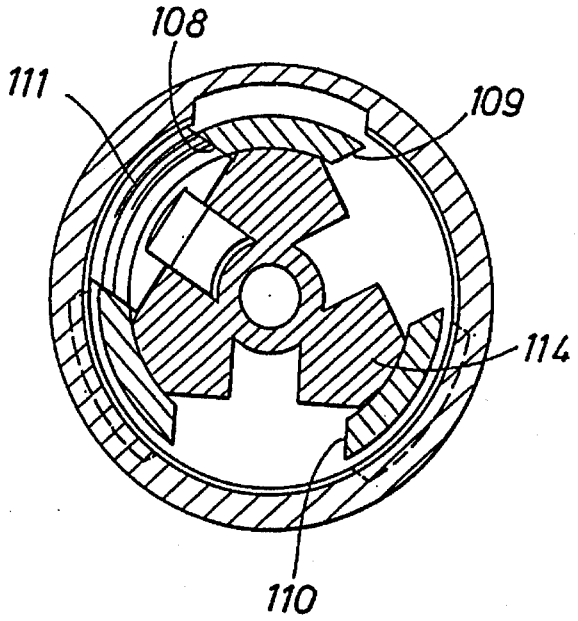
FIG. 13 is a cross-sectional view illustrating the latches of the assembly partially extended as they are initially latched in the casing coupling recesses.
Figure 14:
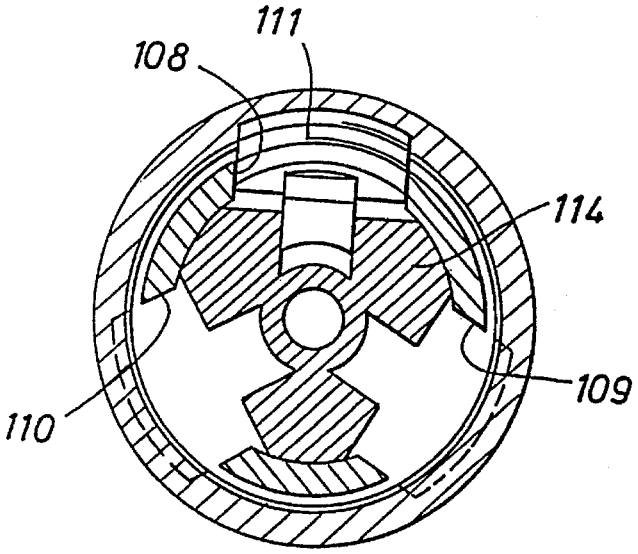
FIG. 14 is a cross-sectional view of the latches of the assembly rotated into their fully extended, latched and oriented positions.
Figure 15:
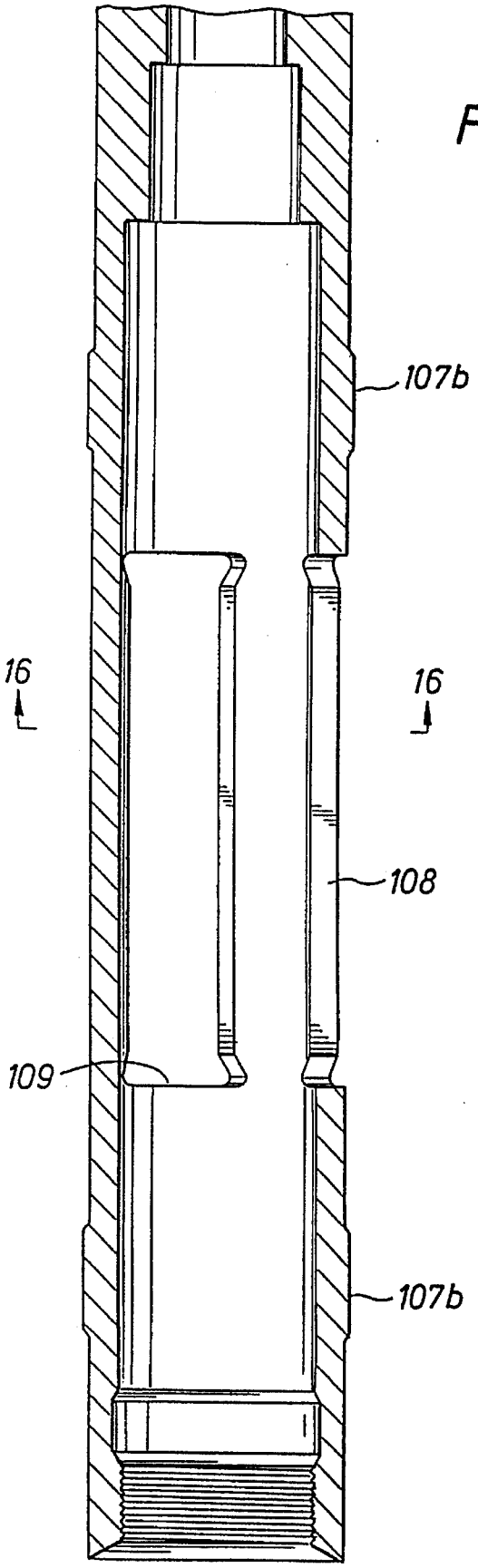
FIG. 15 is a partial vertical cross-sectional view of the latch housing sleeve portion of the assembly of the present invention.
Figure 16:
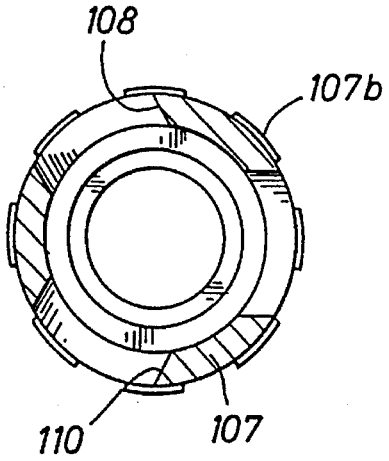
FIG. 16 is a view taken along the line 16—16 of FIG. 15 showing details in the latch housing sleeve.

Referring jointly to FIGS. 9, 12, and 16, the assembly 100 includes a tubular latch housing 107 through which are formed three circumferentially spaced latch windows, 108, 109, and 110. Latches 111, 112, and 113 (FIGS. 11*a*, 11*b*, and 11*c*) are positioned for radial movement through their respective coinciding latch windows as best illustrated in FIG. 12. For clarity, only latch 108 is illustrated in FIGS. 12, 13 and 14.

As illustrated best in FIGS. 9 and 12, the latches are positioned on a latch carrier 114 which holds each latch segment in its respective housing window. The ends of the latches engage spring loaded latch rings 115 and 116 (FIG. 9) which are urged toward each other by two sets of Bellville springs 117 and 118. Tapered surfaces 115*a* and 116*a* on the latch rings 115 and 116, respectively, engage oppositely tapered surfaces such as the surfaces 111*a* and 111*b*, (FIG. 11*a*) on the latch segments, to force the latch segments to move radially outwardly.

The assembly 100 is dimensioned to fit snugly against the internal surface of the pipe within which it is to operate so that the latches 111,112 and 113 are in firm sliding engagement with the internal pipe surface. The amount of force urging the latches outwardly is determined by selecting the appropriate number and strength of elements in the spring assemblies 117 and 118 and by selecting appropriate inclined surfaces for engagement between the latches and the recess contours.

A bull nose nut 119 threadedly engaged to the bottom end of the assembly 100 may be adjusted as required to accommodate different spring configurations. A bull nose spacer 120, having the desired axial length, is positioned between the nut 119 and the housing 107 to permit the nut to be securely tightened onto the housing.

FIG. 16 illustrates protective pads 107*b* positioned about the outer circumference of the housing 107. These pads assist in centering and protecting the latch elements in the assembly as it is lowered through the well pipe.

FIG. 9 illustrates the assembly in its normal "running-in" position as it would be with the latches riding against the nominal (un-recessed) internal surface of the well casing.

FIG. 10 illustrates the assembly in position within a specially recessed casing coupling 121. The coupling 121 is internally threaded at its ends to mate with corresponding external threads formed at the ends of casing joints. The coupling 121 is positioned in the well bore at a known depth and with a known circumferential orientation to function with the assembly 100 in anchoring and orienting a subsurface well tool attached to the upper end 107*a* of the housing 107.

As illustrated in FIG. 17, the coupling 121 is provided with an internally recessed area indicated generally at R which has a series of grooves and slots developed radially outwardly from the coupling's central axis. The result is a specially contoured area where the internal casing diameter is increased relative to the normal internal diameter of the connected casing.

The recessed area R includes slotted sections, S1, S2, and S3 which are only partially developed circumferentially about the internal recessed area R. These slotted sections and their placement are schematically illustrated in FIG. 18. The slots S cooperate with annular grooves G in the recessed area R to provide the unique anchoring and orienting features of the present invention.

As best seen by reference to FIG. 17, the slots S are deeper (extend radially further from the coupling axis) than the grooves G. Additionally, the grooves G extend entirely around the internal surface of the coupling while the slots have limited circumferential development. Each slot set, S1, S2, and S3 also has different axial positioning relative to any other slot set. As may be seen by reference to FIG. 11*a*, 11*b*, and 11*c*, the sliding latch surfaces of the latches 111, 112 and 113 also have profiles which are different from each other.

In operation, when the assembly 100 is lowered into the coupling 121, the latches 111, 112 and 113 partially extend radially into the recess area R as the grooves G are aligned with opposing projecting contours on the latch profiles. When the assembly is rotated, the latches fully extend radially once the latches meet their appropriate slots. Because of the unique match of slots with latches, this occurs at only one circumferential orientation of the assembly 100 within the recessed area R.

As illustrated in FIG. 10, full extension of the latches places square shouldered sections 111*c*, 111*d*, 112*c*, 112*d*, 113*c*, and 113*d* (FIGS. 11*a*, 11*b*, and 11*c*) into engagement with square shoulders formed in the recessed area R to prevent further downward movement of the assembly 100.

During the time the assembly 100 is within the recessed area R with the latches partially extended but before they have engaged their slots, the assembly 100 can be moved up or down through the coupling by increasing the force exerted through the drill string. The increased force is required to overcome the engagement of the grooves G with the mating projections on the spring loaded latches. This increase in force is measurable at the well surface and provides an indication to the operator that the assembly is in the coupling 121.

Rotation of the drill string 103 to the right aligns the slots and appropriate latches, permitting the latches to spring fully outwardly into the slots. This engagement of slots and latches prevents further rotation of the assembly 100 relative to the coupling 121. The anchored, oriented position is detected at the surface by a sharp increase in the amount of torque being applied to rotate the drill string. Further confirmation of anchoring and orientation is obtained by confirming that the assembly 100 does not move down in response to a downward drill string force equivalent to that which was capable of moving the assembly through the recessed area before orientation.

In an example of a practical application of the invention, the assembly 100 is lowered by the drill string into a well casing until it is in the vicinity of the coupling 121. The operator observing a surface weight indicator notes a decrease of approximately twenty thousand pounds in the string weight coinciding with the latches springing out approximately ⅛" into initial engagement with the recess area R. An upward pull on the drill string is exerted to release the assembly 100. This release force will be seen to exceed the normal, non-engaged weight of the string by approximately 20,000 pounds. This provides confirmation that the assembly has been engaged with the recess area R.

The string is then relowered until the weight indicator again shows a string weight loss of 20,000 pounds. The drill string is rotated to the right until the latches engage and fully expand radially into their respective slot sets. This prevents further assembly rotation which in turn produces a sharp increase in reaction torque which is noted at the surface. This provides confirmation that the assembly has been properly anchored and oriented within the coupling 121. Further confirmation is obtained by resting another 20,000 pounds of string weight on the assembly to ensure that the assembly does not move downwardly. Release of the tool is effected by lifting approximately 40,000 pounds which removes the 20,000 pound test weight and provides the additional 20,000 pounds of force to free from the recesses.

While the preferred embodiment of the invention has been described for use with three latches, it will be appreciated that fewer or more latches may be used without departing from the spirit of the invention. Similarly, the recesses may be formed within the casing itself, a sub assembly or other string component and need not necessarily be formed within a casing coupling.

It will further be understood that various means may be provided to produce the biasing force which urges the latches outwardly. Also, while slots and grooves and matching latch contours have been described in the preferred form of the invention, other techniques for ensuring that only specific elements of the assembly 100 will mate with corresponding elements of the coupling 121 to produce a two step radial expansion and a non-rotatable orientation may be employed.

Thus there has been described herein the preferred embodiment of a system for maintaining the pressure integrity of a casing joint having a easily drillable exit port. However, the invention is to be construed most broadly and to be limited only by the appended claims.

What is claimed is:

1. A casing assembly for use in drilling lateral boreholes, comprising:

a joint of tubular casing having a central passage and a drilling bit exit port in the lateral wall thereof for receiving a drilling bit extending from said central passage; and a tubular sleeve fixedly positioned within said central passage of said joint of tubular casing, the outer surface of said sleeve being sealed against the inner surface of said tubular casing on opposing sides of said exit port.

2. The casing assembly according to claim 1, including in addition thereto, at least one layer of easily drillable material covering said exit port.

3. The casing assembly according to claim 2, wherein said easily drillable material comprises fiberglass.

4. The casing assembly according to claim 2, wherein said exit port is filled with fluid, thereby causing said easily drillable material covering said exit port to be less sensitive to pressure deformation.

5. The casing assembly according to claim 1, wherein said sleeve is fixedly positioned within said tubular casing with a plurality of shearable set screws.

6. A casing assembly as defined in claim 5, further including annular seals on opposing sides of said set screws.

7. A casing assembly as defined in claim 5, wherein said set screws extend through said lateral wall of said casing and against the outer surface of said sleeve.

8. A casing assembly as defined in claim 1, wherein said exit port is operatively connected with an orienting surface whereby said exit port may be positioned at a desired orientation by an orienting means in the direction of a lateral borehole to be drilled.

9. A casing assembly as defined in claim 1, wherein the opening dimensions of said drilling bit exit port are approximately the same as, or are greater than, the opening dimensions of said central passage.

10. A casing assembly as defined in claim 1, wherein said tubular sleeve is operatively connected with an orienting surface adapted for use with a survey instrument for orienting said exit port in a desired lateral borehole direction.

11. A method of installing a joint of tubular casing in an earth borehole having an exit port in a sidewall of said tubular casing and a tubular sleeve positioned within the interior of said tubular casing, comprising:

running said joint of tubular casing down to the desired depth in the borehole;

orienting said joint of tubular casing;

cementing said joint of tubular casing; and retrieving said tubular sleeve from said joint of tubular casing, thereby placing said joint of tubular casing in position to accommodate the easy drilling of a lateral borehole through said exit port.

12. The method according to claim 11, including in addition thereto, the steps of filling said exit port with a fluid and then covering said exit port with at least one layer of easily drillable material prior to running said joint of tubular casing down to the desired depth in the borehole.

13. A casing assembly, for use in drilling lateral bore holes, comprising:

a joint of tubular casing having an exit port in the lateral wall thereof; and a tubular sleeve fixedly positioned within the interior of said joint of tubular casing, the outer surface of said sleeve being sealed against the inner surface of said tubular casing on opposing sides of said exit port, at least one layer of easily drillable material covering said exit port, wherein said easily drillable material comprises fiberglass.

14. A casing assembly for use in drilling lateral boreholes, comprising:

a joint of tubular casing having an exit port in the lateral wall thereof; and a tubular sleeve fixedly positioned within the interior of said joint of tubular casing, the outer surface of said sleeve being sealed against the inner surface of said tubular casing on opposing sides of said exit port, wherein said exit port is filled with fluid, thereby causing said easily drillable material covering said exit port to be less sensitive to pressure deformation.

15. A method of installing a joint of tubular casing in an earth borehole having an exit port in a sidewall of said tubular casing and a tubular sleeve positioned within the interior of said tubular casing, comprising:

running said joint of tubular casing down to the desired depth in the borehole;

orienting said joint of tubular casing;

cementing said joint of tubular casing; and removing said tubular sleeve from said joint of tubular casing, thereby placing said joint of tubular casing in position to accommodate the easy drilling of a lateral borehole through said exit port.

16. The method according to claim 15, including in addition thereto the steps of filling said exit port with a compression-resistant filling material and then covering said exit port with at least one layer of easily drillable material prior to running said joint of tubular casing down to the desired depth in the borehole.

* * * * *

UNITED STATES PATENT AND TRADEMARK OFFICE

CERTIFICATE OF CORRECTION

PATENT NO. : 5,615,740

DATED : April 1, 1997

INVENTOR(S) : Laurier E. Comeau; Ian Gillis; Elis Vandenberg

It is certified that error appears in the above-indentified patent and that said Letters Patent is hereby corrected as shown below:

In column 4, line 51, change "48" to --47--.

Signed and Sealed this

Eighth Day of July, 1997

Bruce Lehman

*Attest:*

BRUCE LEHMAN

*Attesting Officer*

*Commissioner of Patents and Trademarks*